US011286753B1

(12) United States Patent
Li et al.

(10) Patent No.: US 11,286,753 B1
(45) Date of Patent: Mar. 29, 2022

(54) SYSTEM AND METHOD FOR EXPLOITING DEEPWATER SHALLOW LOW-ABUNDANCE UNCONVENTIONAL NATURAL GAS BY ARTIFICIAL ENRICHMENT

(71) Applicant: Qingdao Institute of Marine Geology, Qingdao (CN)

(72) Inventors: Yanlong Li, Qingdao (CN); Nengyou Wu, Qingdao (CN); Qiang Chen, Qingdao (CN); Gaowei Hu, Qingdao (CN)

(73) Assignee: QINGDAO UNIVERSITY OF TECHNOLOGY, Qingdao (CN)

( * ) Notice: Subject to any disclaimer, the term of this patent is extended or adjusted under 35 U.S.C. 154(b) by 0 days.

(21) Appl. No.: 17/481,340

(22) Filed: Sep. 22, 2021

(30) Foreign Application Priority Data

Oct. 19, 2020 (CN) ..... 202011115534.0

(51) Int. Cl.
*E21B 41/00* (2006.01)
*E21B 43/01* (2006.01)

(52) U.S. Cl.
CPC ..... *E21B 41/0099* (2020.05); *E21B 43/01* (2013.01)

(58) Field of Classification Search
CPC ..... E21B 41/0099; E21B 43/01
See application file for complete search history.

(56) References Cited

U.S. PATENT DOCUMENTS

2017/0328189 A1* 11/2017 Wang ..... E21B 43/128

* cited by examiner

*Primary Examiner* — Giovanna Wright
*Assistant Examiner* — Yanick A Akaragwe
(74) *Attorney, Agent, or Firm* — Bayramoglu Law Offices LLC

(57) ABSTRACT

A system and method for exploiting deepwater shallow low-abundance unconventional natural gas by artificial enrichment is provided. The system includes a metallogenic system, a transport system and a collection system. The metallogenic system is used for clustering and enriching the deepwater shallow low-abundance nonconventional natural gas to form a natural gas hydrate reservoir. The metallogenic system includes an artificial foundation pit and a dome cap covering the top of the artificial foundation pit. The transport system is used for transporting low-abundance natural gas in a deepwater shallow low-abundance nonconventional natural gas stratum to the metallogenic system to provide a gas source for synthesizing the natural gas hydrate reservoir for the metallogenic system. The transport system includes oriented communication wells connecting the artificial foundation pit and the deepwater shallow low-abundance nonconventional natural gas stratum and filled with gravel particles. The collection system is used for exploiting the natural gas hydrate reservoir.

10 Claims, 1 Drawing Sheet

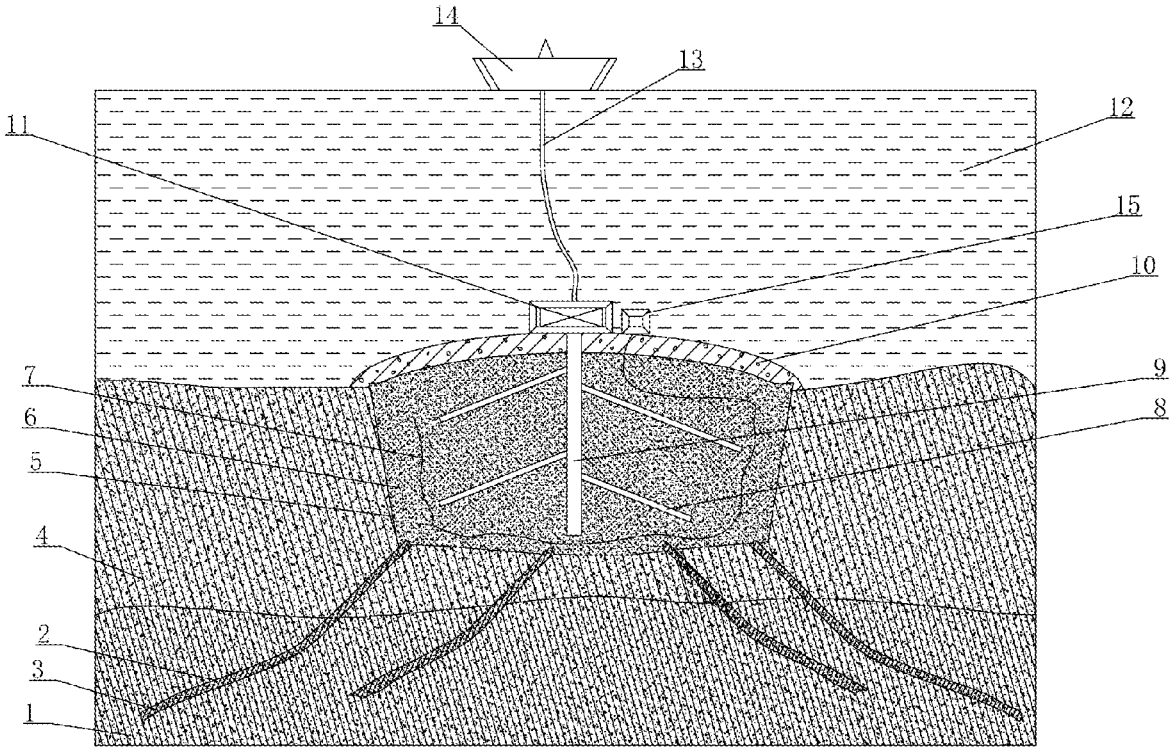
14
13
12
11
15
10
9
8
7
6
5
4
2
3
1

SYSTEM AND METHOD FOR EXPLOITING DEEPWATER SHALLOW LOW-ABUNDANCE UNCONVENTIONAL NATURAL GAS BY ARTIFICIAL ENRICHMENT

CROSS REFERENCE TO THE RELATED APPLICATIONS

This application is based upon and claims priority to Chinese Patent Applications No. 202011115534.0, filed on Oct. 19, 2020, the entire contents of which are incorporated herein by reference.

TECHNICAL FIELD

The invention belongs to the technical field of exploitation of marine unconventional energy, and particularly relates to a system and method for exploiting and utilizing deepwater shallow low-abundance unconventional natural gas by a hydrate-induced metallogenic method.

BACKGROUND

Deepwater shallow low-abundance unconventional natural gas is widely distributed in deepwater non-diagenetic strata, typically contains methane and ethane, and mainly includes hydrates dispersely occurring in argillaceous strata, hydrate-associated gas, and shallow gas occurring in shallow sediments.

For example, existing literature research results show that most shallow gas is biogenetic gas, and organic matter is decomposed to generate a large amount of alkane gas in site, which is clustered in non-diagenetic strata; however, because it is difficult to build wells in the shallow and soft strata where the shallow gas is located to exploit the shallow gas and the cluster degree of the shallow gas is far less than that of deep oil and gas with a complete source-reservoir cap, the exploitation cost of the shallow gas is extremely high. During the exploitation process of deepwater natural gas, shallow gas is usually defined as a shallow geological disaster, the dangers of which are mainly as follows: the shallow gas may escape rapidly during the drilling process, thus leading to a change of the mud density in a wellbore and endangering subsequent well killing operation; and under an extreme condition, seawater may continuously enter the shallow gas, which in turn reduces the density of the seawater and leading to a topple of a semi-submersible platform, thus causing major safety accidents.

Study shows that shallow gas has high dispersity in the common state, extremely low abundance in unit volume and lacks a cap for further promoting enrichment and cluster of the shallow gas, so it is difficult to form a large-scale gas reservoir. However, considering the extensive occurrence of the shallow gas, the possibility that shallow gas will be used as a supplementary fossil energy (similar to the role of existing natural gas hydrates) when conventional oil and gas are exhausted in the future will not be ruled out. So, the shallow gas will be gradually turned from deepwater geological disasters into unconventional fossil energy used by humans with the continuous improvement of science and technology and the ever increasing demand of humans for low-carbon fossil energy.

As mentioned above, the degree of enrichment and abundance of shallow gas in deepwater sediments are extremely low, and the shallow gas usually occurs in low-permeability reservoirs and non-diagenetic strata, so it is difficult to realize large-scale exploitation and utilization of the shallow gas by conventional oil and gas exploitation methods. If a large platform is used to exploit shallow gas in a conventional deepwater oil and gas exploitation mode, complicated engineering geological risks cannot be controlled, and it is extremely difficult to reduce the exploitation cost of shallow gas due to the ultralow permeability of shallow gas reservoirs.

In fact, natural gas hydrates were also once regarded as one of shallow geological disasters in the field of conventional deepwater oil and gas exploitation. In recent years, there has been no doubt about the workability of the marine natural gas hydrate technique with the continuous deepening of the idea of green development and the advance of technology. Although there is still a long way to realize commercial exploitation of natural gas hydrates used as a complementary unconventional fossil energy, it is undeniable that it is a not only a waste of energy, but also a deny to the low-carbon development trend of energy in the future to merely regard natural gas hydrates as a shallow geological disaster.

In addition, it has already been known that over 90% of natural gas hydrates around the world occur in deepwater argillaceous sediments and are low in abundance and high in discreteness, and the permeability of natural gas hydrate reservoirs is extremely low, which makes it impossible to realize large-scale commercial exploitation of such hydrates by conventional oil and gas exploitation methods. Natural gas enriched in such hydrates has similarities with shallow gas, which means that the exploitation methods of the natural gas and the shallow gas also have some similarities. Particularly for class-I natural gas hydrate reservoirs, associated gas adjacent to the bottom boundary of hydrates is an important constituent part of the hydrate system, and thus also belongs to deepwater shallow low-abundance unconventional natural gas.

Compared with shallow gas or hydrate-associated gas, deep-see natural gas hydrates have the feature of high energy density, and after nearly twenty years' development, although there are still great scientific and technical challenges in the exploitation of marine natural gas hydrates, their exploitation technique is more mature than that of shallow gas. Shallow gas may be turned into valuable resources by absorbing extremely low-abundance deepwater shallow unconventional natural gas in strata by a certain artificial dredging system to form high-abundance natural gas hydrate reservoirs in an approximate environment and then exploiting shallow gas by means of the hydrate exploitation technique. Moreover, by artificially forming high-permeability argillaceous high-saturability hydrate reservoirs, the existing bottleneck of argillaceous silty hydrate exploitation efficiency can be effectively overcome. So, there is an urgent need to provide a slow platform-free exploitation solution based on the cognition of marine natural gas hydrate reservoir forming systems and the environments of shallow gas.

SUMMARY

In view of the blank of shallow gas exploitation solutions in the prior art and the existing dilemma of the exploitation of argillaceous silty natural gas hydrates, the invention provides a system and method for exploiting deepwater shallow low-abundance unconventional natural gas by artificial enrichment, which induce low-abundance shallow gas to be enriched to form a high-abundance hydrate reservoir by enriching deepwater shallow low-abundance unconventional natural gas to realize low-cost exploitation of the deepwater shallow low-abundance unconventional natural gas and promote large-scale exploitation of shallow gas, hydrate-associated gas, and hydrates.

The invention is implemented through the following technical solution: a system for exploiting deepwater shallow low-abundance unconventional natural gas by artificial enrichment is provided, the deepwater shallow low-abundance unconventional natural gas hydrates in submarine shallow sediments, associated gas in hydrate reservoirs as well as shallow gas in sediments, and the system comprises a metallogenic system, a transport system and a collection system;

The metallogenic system is used for clustering and enriching deepwater shallow low-abundance nonconventional natural gas to form a high-abundance artificial natural gas hydrate reservoir, and comprises an artificial foundation pit and a dome cap covering the top of the artificial foundation pit, wherein the artificial foundation pit is filled with gravel, and test sensors for testing dynamic evolution characteristics of hydrates during the hydrate synthesis and exploitation process are disposed in the gravel;

The transport system is used for transporting low-abundance natural gas in a deepwater shallow low-abundance nonconventional natural gas stratum to the metallogenic system to provide a gas source for synthesizing the natural gas hydrate reservoir for the metallogenic system, and comprises oriented communication wells connecting the artificial foundation pit and the deepwater shallow low-abundance nonconventional natural gas stratum and filled with gravel particles;

The collection system is used for exploiting the natural gas hydrate reservoir formed by enriching the deepwater shallow low-abundance nonconventional natural gas in the metallogenic system.

Furthermore, the collection system comprises a fixed component and detachable components;

The fixed component comprises a multi-branch exploitation well disposed in the artificial foundation pit, the multi-branch exploitation well comprises a main borehole and a plurality of branch wells dispersely disposed in a circumferential direction of the main wellbore, and an exploitation tree is disposed at a mouth of the main borehole;

The detachable components comprise a data collector, a hydrate gas production line and an exploitation platform, the data collector is connected to the test sensors, and the exploitation platform and the exploitation tree are connected by means of the hydrate gas production line.

Furthermore, the dome cap is made of an impermeable material, or an argillaceous material such as submarine silt, and covers the top of the gravel and is compacted to isolate the internal environment of the artificial foundation pit from seawater.

Furthermore, the test sensors comprise a temperature sensor, a pressure sensor, a resistance measurement sensor, and an acoustic measurement sensor, different test sensors are mounted in a horizontal plane at the same depth and vertical planes at different depths in the artificial foundation pit, and all the test sensors are connected to the data collector.

The invention further provides a method for exploiting deepwater shallow low-abundance unconventional natural gas by artificial enrichment, comprising the following steps:

(1) Determining the position of a hydrate-induced metallogenic province, and building an artificial foundation pit in a region meeting natural gas hydrate synthesis conditions;

(2) Drilling a plurality of oriented communication wells, filling each of the oriented communication wells with gravel particles, and forming a communication channel for connecting a shallow gas stratum and the artificial foundation pit by means of the oriented communication wells;

(3) Disposing a hydrate collection system in the artificial foundation pit, and filling the artificial foundation pit with gravel, wherein the hydrate collection system comprises a multi-branch exploitation well and test sensors;

(4) Disposing a dome cap at the top of the artificial foundation pit, and mounting an exploitation tree and a data collector, wherein the internal environment of the artificial foundation pit (5) is isolated from seawater by the dome cap;

(5) Starting a reservoir formation waiting period;

Wherein, during the reservoir formation waiting process, shallow gas in a deepwater shallow low-abundance unconventional natural gas stratum rises slowly, enters the artificial foundation pit by means of the oriented communication wells, and is enriched in the artificial foundation pit to form a natural gas hydrate reservoir;

(6) Periodically recording hydrate reservoir formation data by the test sensors synchronously with Step (5), and exploiting hydrates when the hydrate abundance of the natural gas hydrate reservoir in the artificial foundation pit meets exploitation requirements; and (7) Stopping exploitation when the gas production rate of hydrates decreases to a set capacity lower limit, and entering a next reservoir formation waiting period to realize sustainable exploitation of shallow gas resources.

Furthermore, in the process of selecting the position of the hydrate-induced metallogenic province in Step (1), the distribution range of the deepwater shallow low-abundance unconventional natural gas is determined first, and the temperature and pressure of a deepwater shallow low-abundance unconventional natural gas occurrence region and an adjacent submarine shallow stratum are measured to ensure that the static seawater pressure and submarine temperature in the artificial foundation pit are equilibrium with the conditions of natural gas hydrates.

Furthermore, under normal circumstances, the permeability of peripheral sediments of a deepwater shallow low-abundance unconventional natural gas overlying stratum where the selected artificial foundation pit is located is lower than that of the shallow gas stratum; and to avoid lateral gas diffusion in the process of forming the natural gas hydrate reservoir in the artificial foundation pit, if the permeability of the peripheral sediments of the selected deepwater shallow low-abundance unconventional natural gas overlying stratum where the artificial foundation pit is located is higher than that of the deepwater shallow low-abundance unconventional natural gas stratum, the artificial foundation pit is poured with cement to be cemented along the outer edge. Furthermore, the gravel filled in the artificial foundation pit forms a porous medium, and the gravel is uniform sand particles and has a non-uniform coefficient less than or equal to 5 and a sorting coefficient less than or equal to 1; and the gravel is artificial ceramsite, glass beads or natural quartz sand with a diameter within or over medium sand range and a density greater than the seawater density.

Furthermore, the multi-branch exploitation well comprises a main borehole and branch wells composed of sand-control mechanical sieve tubes, and the sand arresting precision of the sand-control mechanical sieve tubes is not less than one third of the median grain diameter of the gravel and not greater than two thirds of the median grain diameter of the gravel.

Furthermore, the oriented communication wells drilled in Step (2) are completed with casing pipes and cemented with cement in the deepwater shallow low-abundance unconventional natural gas overlying stratum, and are open wells in the deepwater shallow low-abundance unconventional natural gas stratum.

Compared with the prior art, the invention has the following advantages and beneficial effects:

1. The solution effectively overcome the defects of low abundance and cluster degree of deepwater shallow low-abundance unconventional natural gas by the metallogenic system, the transport system and the collection system, and effectively improves the exploitation and utilization efficiency of shallow gas by enriching the shallow gas to form a high-abundance natural gas hydrate reservoir;

2. The design scheme of the invention is a technique capable of realizing repeated exploitation by one time of investment, and extra maintenance investments are not needed anymore after the metallogenic system, the transport system and the collection system are established;

3. The hydrate exploitation platform does not needs to be in position in the artificial hydrate reservoir formation waiting period and needs to be in position only during exploitation, so that the field operation time of offshore engineering equipment is effectively shortened, and costs are greatly reduced;

4. Sand leaking in the conventional hydrate exploitation process is avoided through the cooperation of the gravel filled in the artificial foundation pit and the sand arresting precision of the mechanical sieve tubes, and the pore space of the gravel is far greater than that of conventional hydrate reservoirs, so that the hydrate reservoir formation and exploitation are facilitated;

5. The invention overcomes the defects of low permeability and exploitation efficiency of argillaceous silty natural gas hydrate reservoirs at present, and realizes sustainable exploitation of the argillaceous silty natural gas hydrate reservoirs by artificially forming sandy high-saturability hydrate reservoirs.

BRIEF DESCRIPTION OF THE DRAWINGS

FIGURE is a structural diagram of a system for exploiting deepwater shallow low-abundance unconventional natural gas by artificial enrichment according to Embodiment 1 of the invention;

1, deepwater shallow low-abundance unconventional natural gas stratum; 2, communication well; 3, gravel particle; 4, deepwater shallow low-abundance unconventional natural gas overlying stratum; 5, artificial foundation pit; 6, gravel; 7, test sensor; 8, branch well; 9, main borehole; 10, dome cap; 11, exploitation tree; 12, seawater; 13, gas production line; 14, exploitation platform; 15, data collector.

DETAILED DESCRIPTION OF THE EMBODIMENTS

To gain a better understanding of the above purposes, features and advantages of the invention, the invention will be further described below in conjunction with accompanying drawings and embodiments. Many specific details are expounded below to allow readers to gain a comprehensive understanding of the invention. Obviously, the invention may also be implemented in other ways different from those described herein. So, the invention is not limited to the specific embodiments disclosed below.

Embodiment 1: As shown in FIGURE, a system for exploiting deepwater shallow low-abundance unconventional natural gas by hydrate enrichment comprises a metallogenic system, a transport system and a collection system;

The metallogenic system comprises a large artificial foundation pit 5 built in a deep sea, gravel 6 filled in the large artificial foundation pit 5, a dome cap 10 covering the top of the large artificial foundation pit 5, and test sensors 7 disposed in the gravel 6, wherein a reserved opening connected to the collection system is designed in the dome cap 10, and the metallogenic system is used for clustering and enriching deepwater shallow low-abundance unconventional natural gas to form a high-saturability natural gas hydrate reservoir in the artificial foundation pit 5;

The transport system comprises oriented communication wells 2 starting from the bottom of the large artificial foundation pit 5 and ending in a deepwater shallow low-abundance unconventional natural gas stratum 1, wherein the oriented communication wells 2 are filled with gravel particles 3; and the transport system is mainly used for transporting low-abundance alkane gas in the deepwater shallow low-abundance unconventional natural gas stratum 1 to the metallogenic system under a long-term accumulation effect to provide a gas source for synthesizing hydrates for the metallogenic system;

The collection system comprises fixed components and detachable components, wherein the fixed components comprise a main borehole 9 disposed in the gravel 6 in the artificial foundation pit 5, branch wells 8, and an exploitation tree 11 mounted in the main borehole 9; and the detachable components comprise a data collector 15, a hydrate gas production line 13 connected to the exploitation tree 11, and a hydrate exploitation platform 14 positioned on a sea surface.

In this embodiment, the metallogenic system meets optimum hydrate formation conditions, and the deepwater shallow low-abundance unconventional natural gas is exploited after being enriched to form a natural gas hydrate reservoir rather than being directly collected. Considering that the amount of deepwater shallow low-abundance unconventional natural gas in unit volume is extremely small, the deepwater shallow low-abundance unconventional natural gas is guided into the artificial foundation pit to be enriched slowly to form hydrates, 1m3 of which contain 164m3 of natural gas and the energy density of which is high, so from the aspects of cost and energy efficiency, the hydrate reservoir is more beneficial to the exploitation of the deepwater shallow low-abundance unconventional natural gas.

Wherein, the artificial foundation pit 5 is a pit built on a sea bottom by the deep-sea excavation technique and has a certain depth and a certain area, and the position of the artificial foundation pit 5 should meet the following special requirements: (1) the static seawater pressure and submarine temperature in the foundation pit should be equilibrium with the conditions of natural gas hydrates; (2) the artificial foundation pit should not be located at a position of a deep-sea slip mass to prevent secondary engineering geological disasters that may be caused in the subsequent exploitation process; and (3) the permeability of peripheral sediments of the artificial foundation pit should be lower than that of the deepwater shallow low-abundance unconventional natural gas stratum deep in the artificial foundation pit and should be as low as possible to prevent lateral leaking of the alkane gas in the foundation pit. It should be noted that once the position of the artificial foundation pit 5 is selected, the temperature and pressure in the foundation pit will not fluctuate greatly, thus meeting suitable conditions for hydrate formation.

Under normal circumstances, the permeability of peripheral sediments of a deepwater shallow low-abundance unconventional natural gas overlying stratum 4 where the selected artificial foundation pit 5 is located is lower than that of the deepwater shallow low-abundance unconventional natural gas stratum 1; and to avoid lateral gas diffusion in the process of forming the natural gas hydrate reservoir in the artificial foundation pit, the artificial foundation pit may be poured with cement to be cemented along the outer edge or be replaced with a large submarine low-temperature storage tank to prevent lateral leaking of the deepwater shallow low-abundance unconventional natural gas.

In addition, the diameter of the gravel 6 is within or over a medium sand range, the density of the gravel 6 is greater than that of artificial ceramsite, glass beads or natural quartz sand with the density greater than the seawater density, and the medium sand range generally refers to the average sand diameter which is greater than 80 meshes. Gravel with a large particle diameter and a density greater than the seawater density should be adopted, that is, a large particle diameter and a large density are more suitable for hydrate synthesis and exploitation and may be set according to actual conditions. The gravel 6 filled in the artificial foundation pit 5 forms a porous medium, and is uniform sand particles with a good sorting property, and the specific standard of the gravel 6 is as follows: the non-uniform coefficient is less than or equal to 5, and the sorting coefficient is less than or equal to 1.

The dome cap 10 is made of an impermeable material and is used for covering the top of the artificial foundation pit, the size of the dome cap 10 should not be less than that of an opening of the artificial foundation pit, the impermeable material may be cement, a metal plate, or the like, and after the artificial foundation pit is covered with the dome cap, the gravel in the artificial foundation pit is isolated from seawater. Under special circumstances, if the artificial foundation pit 5 is deep enough, the gravel 6 may be directly covered with submarine silt and compacted after the artificial foundation pit 5 is excavated, the collection system is installed, and the gravel is filled in the artificial foundation pit 5, that is, a seabed silt backfill layer is used as a dome of the artificial foundation pit, and this is another specific implementation of the dome cap of the invention.

The test sensors 7 are disposed at different spatial positions in the artificial foundation pit 5, and include, but are not limited to, a temperature sensor, a pressure sensor, a resistance measurement sensor and an acoustic measurement sensor capable of operating in a deep-sea low-temperature and high-pressure environment for a long time. Test data of the test sensors 7 are transmitted to the data collector 15 installed on a sea bottom above the dome cap by optical fibers or by cables.

Particularly, the data collector 15 is able to supply power to the test sensors and store data from the test sensors, and in specific implementation, data in the data collector may be retrieved periodically by an underwater robot. In addition, because the test sensors 7 are mainly used to test dynamic evolution characteristics of hydrates in the gravel 6 in the foundation pit during the hydrate synthesis and exploitation process, to test synthesis or decomposition conditions of hydrates at different positions, the spatial installation positions of the test sensors should follow the following principle: (1) sensors of the same type should not be installed in a plane at the same depth (test sensors of different types are installed in a plane at the same depth) and should not be installed in the columnar surface within the same radius range of the center of the foundation pit (test sensors of different types should be installed in vertical planes at different depths): and (2) test sensors of different types should be installed in groups to form different sensor clusters to facilitate mutual verification of different data.

In this embodiment, the extension distance of the orientated communication wells 2 in the deepwater shallow low-abundance unconventional natural gas stratum should be as long as possible, and a large-displacement horizontal well or a multi-branch well should be adopted as long as it is permissible by engineering technical means. Preferably, different oriented communication wells 2 should extend in different directions in the deepwater shallow low-abundance unconventional natural gas stratum to widen the control scope of the transport system.

To prevent the deepwater shallow low-abundance unconventional natural gas from seeping into the overlying stratum when transported to the metallogenic system, the oriented communication wells 2 are completed with casing pipes and cemented with cement in the deepwater shallow low-abundance unconventional natural gas overlying stratum, are open wells in the deepwater shallow low-abundance unconventional natural gas stratum, and are directly filled with gravel particles 3.

Particularly, the median grain diameter of the gravel particles 3 is 5-6 times that of the deepwater shallow low-abundance unconventional natural gas stratum, and the gravel particles 3 are common gravel filling materials. The significant difference of this solution from gravel filling of conventional hydrate exploitation wells is as follows: in this solution, the oriented communication wells 2 have no other columnar structures except the casing pipes adopted in the deepwater shallow low-abundance unconventional natural gas stratum for well cementing, are merely filled with gravel and form a high-permeability gas channel, such that the deepwater shallow low-abundance unconventional natural gas can be slowly diffused into the wellbore and leaks into the metallogenic system.

Referring to FIGURE again, the main borehole is a large-sized casing pipe vertically buried in the gravel in the artificial foundation pit 5. Generally, the main borehole 9 is mounted at the center of the artificial foundation pit 5, and holes for mounting multiple branch wells are pre-formed in the main borehole 9. Wherein, the branch wells 8 are composed of sand control mechanical sieve tubes, the sand control mechanical sieve tubes are correspondingly mounted in the holes in the main borehole after being connected, to form multiple branch holes radially extending in all directions of the artificial foundation pit 5.

Wherein, the cooperation relationship between the sand arresting precision of the sand control mechanical sieve tubes serving as the multiple branch wells and the gravel 6 filled in the artificial foundation pit meet the following requirements: the sand arresting precision (and silt width) of the sand control mechanical sieve tubes should not be greater than two thirds of the median grain diameter of the gravel and should not be less than one third of the median grain diameter of the gravel. That is, the sand arresting precision of the sand control mechanical sieve tubes should be completely meet gravel filling conditions.

Embodiment 2: Based on the system in Embodiment 1, this embodiment provides a method for exploiting deepwater shallow low-abundance unconventional natural gas by artificial enrichment, specifically comprising the following steps:

1. The distribution range of deepwater shallow low-abundance unconventional natural gas is determined by natural gas hydrate research ship onboard equipment and technique through shallow stratum investigation, and the temperature and pressure of a deepwater shallow low-abundance unconventional natural gas occurrence region and an adjacent submarine shallow stratum are measured, and a hydrate-induced metallogenic province is selected;

2. A large artificial foundation pit 5 is formed in the selected hydrate-induced metallogenic province by means of submarine tunneling or submarine excavation, and a plurality of orientated communication wells 2 are drilled in the bottom and bottom edge of the large artificial foundation pit 5 according to the position of deepwater shallow low-abundance unconventional natural gas; each of the oriented communication wells 2 is filled with gravel 3 to form a high-permeability channel connecting a deepwater shallow low-abundance unconventional natural gas stratum 1 and the artificial foundation pit 5;

3. A main borehole 9 and a plurality of oriented branch wells 8 are disposed in the large artificial foundation pit 5, wherein the branch wells 8 are pre-perforated casing pipes or sieve tubes in conventional oil and gas, the main borehole 9 is a large-sized casing pipe preformed with connecting holes, the multiple branch wells 8 are connected to the main borehole 9, and the main borehole 9 is connected to the plurality of branch wells 8 and are not provided with other perforated boreholes or reserved holes;

In addition, a long-term monitoring device (in which sensors are embedded) such as an optical fiber temperature and pressure monitoring system may be disposed in a geometric structure when a well net of a complicated structure is configured to monitor internal data of the metallogenic system in the hydrate reservoir formation process;

4. The large artificial foundation pit 5, on which wells of a complicated structure are mounted, is filled with gravel 6 by means of a large engineering ship, wherein the size of the gravel 6 is determined according to the sand arresting precision of the sieve tubes prearranged in the branch wells, and the design principle is that sand leaking will not occur when fluid in the gravel is extracted;

Wherein, after the artificial foundation pit 5 is filled with the gravel 6, the well mouth of the main borehole 9 should be above the upper boundary of a gravel filling surface by a certain distance to facilitate subsequent installation of an artificial well mouth;

5. Early strength cement is sprayed to the top of the foundation pit to form a cover dome, namely a dome cap of a hydrate reservoir, to prevent gas entering the gravel layer in the foundation pit from overflowing into sea water, 6. An exploitation tree is mounted with the assistance of a submarine robot, wherein the exploitation tree is installed at the mouth of the main borehole, and a gate is closed after the exploitation tree is mounted;

7. A reservoir formation waiting period is started: after the above step is completed, the reservoir formation period is started, the deepwater shallow low-abundance unconventional natural gas rises under the effect of a concentration difference and gravity in the waiting period (the concentration of the deepwater shallow low-abundance unconventional natural gas in the deepwater shallow low-abundance unconventional natural gas stratum 1 decreases from bottom to top, so the deepwater shallow low-abundance unconventional natural gas is slowly diffused upwards), and enters a gravel storage space in the artificial foundation pit by means of an oriented gravel-filled channel formed in Step 2, and the temperature and pressure in the gravel storage space are suitable for the growth of hydrates, so that hydrocarbon gas is enriched in the gravel storage space to generate hydrates;

8. Hydrate reservoir formation data, such as the temperature, pressure sediment wave velocity and electrical conductivity in the hydrate synthesis process, are recorded in real time by test sensors installed in the artificial hydrate reservoir synchronously with Step 7, and when the hydrate abundance in the artificial hydrate reservoir meets exploitation requirements, an offshore pilot production ship and a line are connected, and then the gate of the exploitation tree is opened to exploit hydrates;

9. When the gas production rate of the hydrates decreases to a set capacity lower limit, it indicates that the hydrates in the artificial hydrate reservoir has been exploited completely, then the gate of the exploitation tree is closed, the exploitation platform and the line are removed, and a next hydrate-induced metallogenic period is started;

10. Steps 7-9 are repeated to realize sustainable exploitation of deepwater shallow low-abundance unconventional natural gas resources.

As can be known from above, deepwater shallow low-abundance unconventional natural gas is enriched by means of the natural advantages of high pressure and low temperature in deep seas to be induced to form a high-abundance natural gas hydrate reservoir easy to exploit, and then natural gas hydrates are exploited at a low cost, such that the purposes of reducing the exploitation cost of the deepwater shallow low-abundance unconventional natural gas and turning shallow gas into valuable resources are realized, and, technical support is provided for promoting large-scale exploitation of the shallow gas.

The above embodiments are merely preferred ones of the invention, and are not intended to limit the invention in any forms. Any skilled in the art may make modifications or transformations based on the technical contents disclosed above to obtain equivalent embodiments applied to other fields. Any simple amendments, equivalent variations and transformations made to the above embodiments according to the technical essence of the invention without departing from the technical solutions of the invention should also fall within the protection scope of the technical solutions of the invention.

What is claimed is:

1. A system for exploiting a deepwater shallow low-abundance unconventional natural gas by artificial enrichment, comprising a metallogenic system, a transport system and a collection system, wherein the deepwater shallow low-abundance unconventional natural gas comprises hydrates in submarine shallow sediments, associated gas in hydrate reservoirs, and shallow gas in sediments, wherein:

the metallogenic system is used for clustering and enriching the deepwater shallow low-abundance nonconventional natural gas to form a natural gas hydrate reservoir; the metallogenic system comprises an artificial foundation pit and a dome cap covering a top of the artificial foundation pit; the artificial foundation pit is filled with gravel, and test sensors for testing dynamic evolution characteristics of the hydrates during a hydrate synthesis and exploitation process are disposed in the gravel;

the transport system is used for transporting low-abundance natural gas in a deepwater shallow low-abundance nonconventional natural gas stratum to the metallogenic system to provide a gas source for synthesizing the natural gas hydrate reservoir for the metallogenic system; the transport system comprises oriented communication wells connecting the artificial foundation pit and the deepwater shallow low-abundance nonconventional natural gas stratum and filled with gravel particles;

the collection system is used for exploiting the natural gas hydrate reservoir formed by enriching the deepwater shallow low-abundance nonconventional natural gas in the metallogenic system.

2. The system for exploiting the deepwater shallow low-abundance unconventional natural gas by the artificial enrichment according to claim 1, wherein the collection system comprises a fixed component and detachable components;

the fixed component comprises a multi-branch exploitation well disposed in the artificial foundation pit; the multi-branch exploitation well comprises a main borehole and a plurality of branch wells dispersely disposed in a circumferential direction of the main wellbore, and an exploitation tree is disposed at a mouth of the main borehole;

the detachable components comprise a data collector, a hydrate gas production line and an exploitation platform; the data collector is connected to the test sensors, and the exploitation platform and the exploitation tree are connected by means of the hydrate gas production line.

3. The system for exploiting the deepwater shallow low-abundance unconventional natural gas by the artificial enrichment according to claim 2, wherein the test sensors comprise a temperature sensor, a pressure sensor, a resistance measurement sensor, and an acoustic measurement sensor; different test sensors are mounted in a horizontal plane at a same depth and vertical planes at different depths in the artificial foundation pit, and all the test sensors are connected to the data collector.

4. The system for exploiting the deepwater shallow low-abundance unconventional natural gas by the artificial enrichment according to claim 1, wherein the dome cap is made of an impermeable material, or an argillaceous material, and the argillaceous material directly covers a top of the gravel and is compacted.

5. A method for exploiting a deepwater shallow low-abundance unconventional natural gas by artificial enrichment, comprising the following steps:

step (1): determining a position of a hydrate-induced metallogenic province, and building an artificial foundation pit;

step (2): drilling a plurality of oriented communication wells, filling each of the plurality of oriented communication wells with gravel particles, and forming a communication channel for connecting a deepwater shallow low-abundance unconventional natural gas stratum and the artificial foundation pit by means of the plurality of oriented communication wells;

step (3): disposing a hydrate collection system in the artificial foundation pit, and filling the artificial foundation pit with gravel, wherein the hydrate collection system comprises a multi-branch exploitation well and test sensors;

step (4): disposing a dome cap at a top of the artificial foundation pit, and mounting an exploitation tree and a data collector, wherein an internal environment of the artificial foundation pit is isolated from seawater by the dome cap;

step (5): starting a reservoir formation waiting period; wherein, during the reservoir formation waiting process, the deepwater shallow low-abundance unconventional natural gas in the deepwater shallow low-abundance unconventional natural gas stratum rises slowly, enters the artificial foundation pit by means of the plurality of oriented communication wells, and is enriched in the artificial foundation pit to form a natural gas hydrate reservoir;

step (6): recording hydrate reservoir formation data by the test sensors synchronously with step (5), and exploiting hydrates when a hydrate abundance of the natural gas hydrate reservoir in the artificial foundation pit meets exploitation requirements; and step (7): stopping exploitation when a gas production rate of the hydrates decreases to a set capacity lower limit, and entering a next reservoir formation waiting period to realize sustainable exploitation of deepwater shallow low-abundance unconventional natural gas resources.

6. The method for exploiting the deepwater shallow low-abundance unconventional natural gas by the artificial enrichment according to claim 5, wherein in a process of selecting the position of the hydrate-induced metallogenic province in step (1), a distribution range of the deepwater shallow low-abundance unconventional natural gas is determined first, and a temperature and a pressure of a deepwater shallow low-abundance unconventional natural gas occurrence region and an adjacent submarine shallow stratum are measured to ensure that a static seawater pressure and a submarine temperature in the artificial foundation pit are equilibrium with conditions of natural gas hydrates.

7. The method for exploiting the deepwater shallow low-abundance unconventional natural gas by the artificial enrichment according to claim 5, wherein when a permeability of peripheral sediments of a deepwater shallow low-abundance unconventional natural gas overlying stratum where a selected artificial foundation pit is located is higher than a permeability of the deepwater shallow low-abundance unconventional natural gas stratum, the artificial foundation pit is poured with cement to be cemented along an outer edge.

8. The method for exploiting the deepwater shallow low-abundance unconventional natural gas by the artificial enrichment according to claim 5, wherein the gravel filled in the artificial foundation pit forms a porous medium, and the gravel is uniform sand particles and has a non-uniform coefficient less than or equal to 5 and a sorting coefficient less than or equal to 1.

9. The method for exploiting the deepwater shallow low-abundance unconventional natural gas by the artificial enrichment according to claim 5, wherein the multi-branch exploitation well comprises a main borehole and branch wells composed of sand-control mechanical sieve tubes, and a sand arresting precision of the sand-control mechanical sieve tubes is not less than one third of a median grain diameter of the gravel and not greater than two thirds of the median grain diameter of the gravel.

10. The method for exploiting the deepwater shallow low-abundance unconventional natural gas by the artificial enrichment according to claim 5, wherein the plurality of oriented communication wells drilled in step (2) are completed with casing pipes and cemented with cement in the deepwater shallow low-abundance unconventional natural gas overlying stratum, and are open wells in the deepwater shallow low-abundance unconventional natural gas stratum.

* * * * *